US008408525B2

(12) United States Patent
Gräter et al.

(10) Patent No.: US 8,408,525 B2
(45) Date of Patent: Apr. 2, 2013

(54) CARBURETOR ASSEMBLY

(75) Inventors: Werner Gräter, Berglen (DE); Tobias Baur, Gestratz (DE); Birger Loew, Wendlingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 494 days.

(21) Appl. No.: 12/659,753

(22) Filed: Mar. 19, 2010

(65) Prior Publication Data

US 2010/0237515 A1 Sep. 23, 2010

(30) Foreign Application Priority Data

Mar. 21, 2009 (DE) ..... 10 2009 014 347

(51) Int. Cl.
*F02M 23/03* (2006.01)

(52) U.S. Cl. ..... 261/47; 261/52; 261/56; 261/DIG. 1

(58) Field of Classification Search ..... 261/47, 261/52, 56, DIG. 1; 123/73 PP
See application file for complete search history.

(56) References Cited

U.S. PATENT DOCUMENTS

| | | | | |
|---|---|---|---|---|
| 6,708,958 | B1 * | 3/2004 | Warfel et al. | 261/45 |
| 6,896,245 | B2 * | 5/2005 | Suzuki et al. | 261/23.2 |
| 6,957,633 | B2 * | 10/2005 | Toda et al. | 123/65 R |
| 7,377,496 | B2 * | 5/2008 | Toda et al. | 261/43 |
| 2004/0065965 | A1 | 4/2004 | Warfel et al. | |
| 2004/0130039 | A1 * | 7/2004 | Suzuki et al. | 261/23.2 |
| 2006/0087046 | A1 * | 4/2006 | Toda et al. | 261/43 |

FOREIGN PATENT DOCUMENTS

| | | | | |
|---|---|---|---|---|
| JP | 61-61954 A | * | 3/1986 | 261/52 |

* cited by examiner

*Primary Examiner* — Richard L Chiesa
(74) *Attorney, Agent, or Firm* — Walter Ottesen

(57) ABSTRACT

A carburetor assembly (1) has an intake channel section (30) and an air channel section (31). In the intake channel section (30), a throttle element and a choke element are arranged. An air control element is arranged in the air channel section (31). A first coupling unit (25) is provided which defines the position of the throttle element in at least one start position of the carburetor assembly (1). A second coupling unit (26) couples the position of the air control element in at least one operating state to the position of the throttle element. To ensure a reliable start, the choke element is held in at least one start position by the first coupling unit (25) and the second coupling unit (26).

15 Claims, 5 Drawing Sheets

CARBURETOR ASSEMBLY

CROSS REFERENCE TO RELATED APPLICATION

This application claims priority of German patent application no. 10 2009 014 347.5, filed Mar. 21, 2009, the entire content of which is incorporated herein by reference.

BACKGROUND OF THE INVENTION

From US 2004/0065965 A1, a carburetor assembly is known that has a first coupling unit with which a start position of the choke element and the throttle element can be set as well as a second coupling unit which couples the position of the air flap to the position of the throttle flap.

It has been shown that, during operation of such a carburetor assembly, a latching between throttle element and choke element can disengage under unfavorable conditions.

SUMMARY OF THE INVENTION

It is an object of the invention to provide a carburetor assembly of the kind described above wherein the choke element is securely held in at least one start position.

The carburetor assembly of the invention includes: an intake channel having a throttle element and a choke element arranged therein; an air channel having an air control element arranged therein; a first coupling unit configured to define the position of the throttle element in at least one start position of the carburetor assembly; a second coupling unit for coupling the position of the air control element to the position of the throttle element in at least one operating mode; and, the first coupling unit and the second coupling unit coacting to hold the choke element in at least one start position.

Because the choke element is held by the first as well as the second coupling units there results a reliable fixation of the choke element. No additional components are required for the fixation of the choke element, since the fixation can be achieved by the already present coupling units. Generally, a fixation of the choke element is achieved already by the first coupling unit. In the present invention, the second coupling unit is additionally used for fixing the choke element.

Advantageously, the choke element is held clamped in the starting position between an element of the first coupling unit and an element of the second coupling unit. The clamping enables a simple fixation of the choke element and also a simple disengagement, since only the clamping force must be overcome and no additional disengagement devices need be actuated. A simple configuration results when at least one of the elements is spring mounted. Advantageously, the start position is a cold start position. This position is generally disengaged when the operator manipulates the choke element. While releasing the choke element, the operator can at the same time disengage the clamping on the choke element which results in a simple manipulation unchanged from previous configurations.

Advantageously, the first coupling unit has a cam contour that defines at least one start position. The cam contour thereby preferably defines a cold start position wherein the choke element and the throttle element are substantially closed, as well as a warm start position wherein the choke element is only marginally closed and the throttle element is partially closed. The throttle element can be in about the same position for both start positions. Advantageously, the first coupling unit has a blocking contour that prevents a setting of the choke element when the throttle element is closed. This ensures that the choke element can only be set when the operator activates the throttle and thus expressly wants to set the choke element. The first coupling unit has a choke lever, which is fixedly connected to the choke element so as to rotate therewith, and a throttle lever which is fixedly connected to the throttle element so as to rotate therewith. The cam contour and the blocking contour are then preferably disposed on the throttle lever.

A simple configuration results when the choke lever has an actuating cam which interacts with the cam contour and the blocking contour. Advantageously, the second coupling unit has a coupling contour to actuate the air control element. The desired opening characteristic of the air control element can be set based on the shape of the coupling contour. Advantageously, the second coupling unit has a blocking section which interacts with the choke lever. The coupling contour and the blocking section are preferably offset from one another in the direction of the pivot axis of the throttle element. Advantageously, the second coupling unit has a coupling lever, which is pivotally journalled with respect to the throttle element, and an air flap lever which is fixedly connected to the air control element so as to rotate therewith. The coupling contour and the blocking section are advantageously provided on the coupling lever.

Advantageously, the carburetor assembly has an operating-mode position selector to set at least one start position which acts on the choke element.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
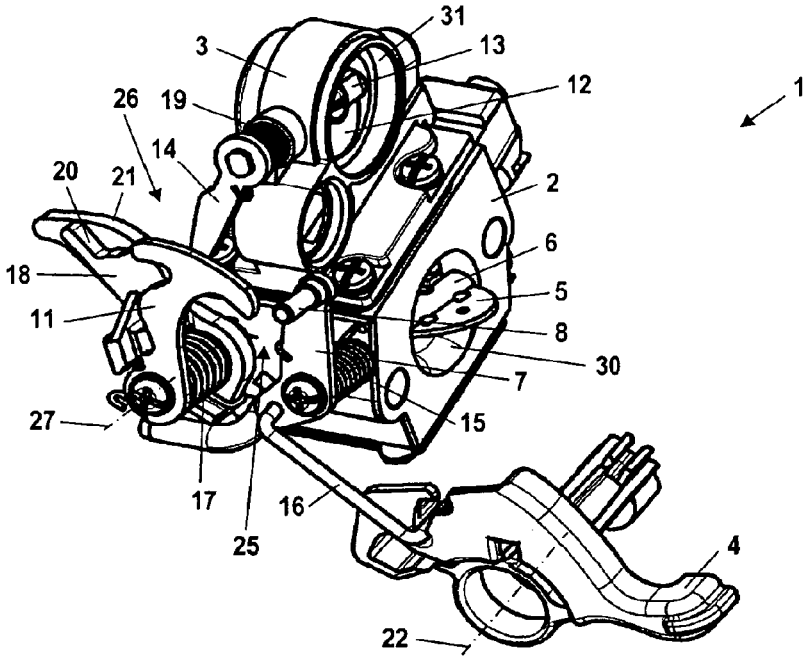
FIG. 1 is a perspective view of the carburetor assembly in an unactuated position.

FIG. 1 shows a carburetor assembly 1 that, for example, could be used in a portable handheld work apparatus such as a motor-driven chain saw, a cutoff machine or the like in connection with a scavenging advance internal combustion engine. The carburetor assembly 1 has a carburetor 2 on which an air channel component 3 is held. In the carburetor 2, there is an intake channel section 30 through which an air/fuel mixture is supplied to the internal combustion engine. In the air channel component 3, there is a air channel section 31 through which substantially fuel-free air is supplied to the engine.

Figure 2:
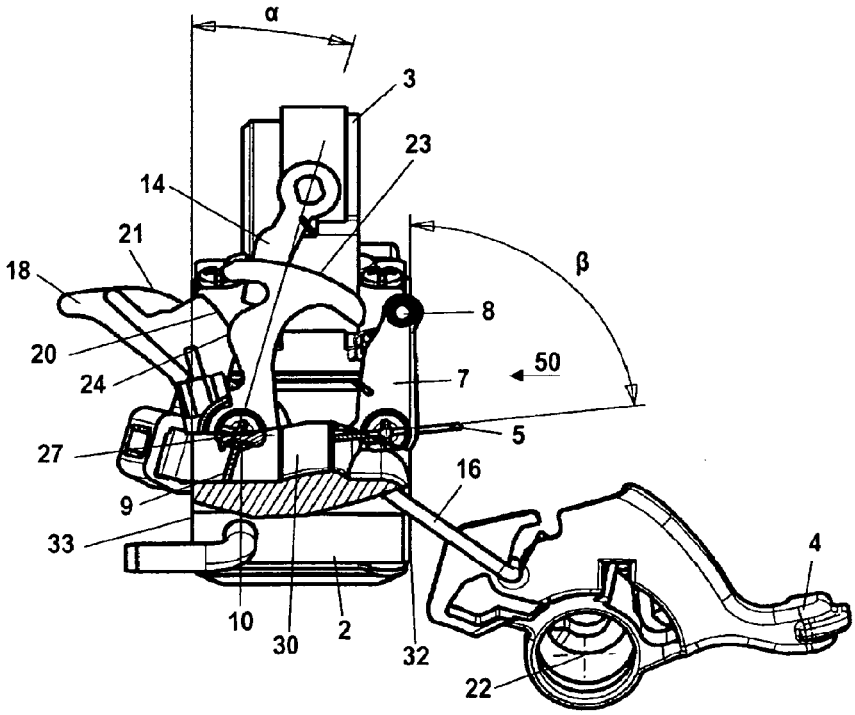
FIG. 2 is a side elevation view of the carburetor assembly of FIG. 1 shown partially in section.

In the intake channel section 30, a choke flap 5 is pivotally journalled with a choke shaft 6. Outside the intake channel section 30, a choke lever 7 is fixedly arranged on the choke shaft 6 so as to rotate therewith. An operating-mode position selector 4 acts on the choke lever 7 via a coupling rod 16. The operating-mode position selector 4 is pivotally journalled about a pivot axis 22 for the selection of different modes of operation. With the operating-mode position selector 4, the following can be selected: an off position, in which the ignition of the combustion engine is short circuited, an operating position as well as at least one start position. In the embodiment, two start positions are provided for the operating-mode position selector 4, specifically a cold start position and a warm start position. In FIG. 1, the operating-mode position selector 4 is shown in the operating position. As shown in FIG. 2, the choke flap 5 in this position is aligned approximately in the direction of the intake channel longitudinal axis and defines an angle β with the end face of the carburetor 2. The angle β is advantageously about 80° to about 90°.

As FIG. 1 shows; the choke shaft 6 is spring biased with a spring 15 in the direction of the entirely open position shown in FIGS. 1 and 2. The choke lever 7 has an actuating cam 8 disposed thereon via which the choke lever 7 can interact with a throttle lever 11. The throttle lever 11 is fixedly arranged on a throttle shaft shown in FIG. 2 so as to rotate therewith. With the throttle shaft 10, a throttle flap 9 is pivotally mounted in the intake channel section 30. In relation to the flow direction 50 in the intake channel, the throttle flap 9 is arranged downstream of the choke flap 5.

As FIGS. 1 and 2 show, a coupling lever 18 is also disposed on the throttle shaft 10 with the coupling lever being pivotally mounted with a spring on the throttle shaft 10 and being spring biased thereby. The coupling lever 18 has a blocking section 20, which can interact with the choke lever 7 during operation, as well as a coupling contour 21 which interacts with an air flap lever 14. The air flap lever 14 is fixedly held on an air flap shaft 13 so as to rotate therewith. With the air flap shaft 13, an air flap 12 is pivotally journalled in the air channel section 31. A spring 19, which presses the air flap 12 into a completely closed position shown in FIG. 1, is arranged on the air flap shaft 13.

The throttle lever 11 and the choke lever 7 conjointly form the first coupling unit 25 which defines a plurality of start positions of the throttle flap 9 and the choke flap 5. For this purpose, the throttle lever 11 has a cam contour 24 which has several latching recesses for the actuating cam 8. The coupling contour 21 of the coupling lever 18 in conjunction with air flap lever 14 forms a second coupling unit 26 which couples the position of the air flap 12 to the position of the throttle flap 9. In the idle position shown in FIGS. 1 and 2, the throttle flap 9 is closed and defines an angle α of about 10° to about 20° with a downstream end face 33 of carburetor 2. The air flap 12 is also completely closed.

Figure 3:
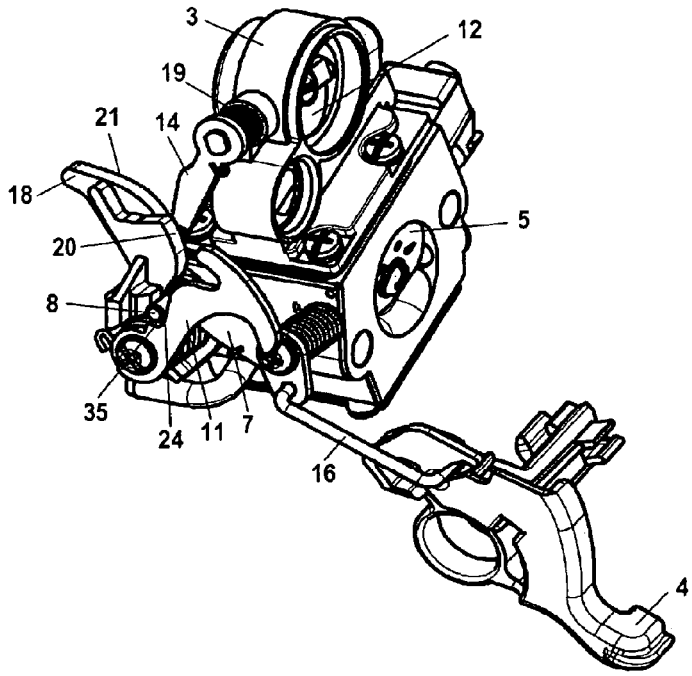
FIG. 3 is a perspective view of the carburetor assembly in a cold start position.
Figure 4:
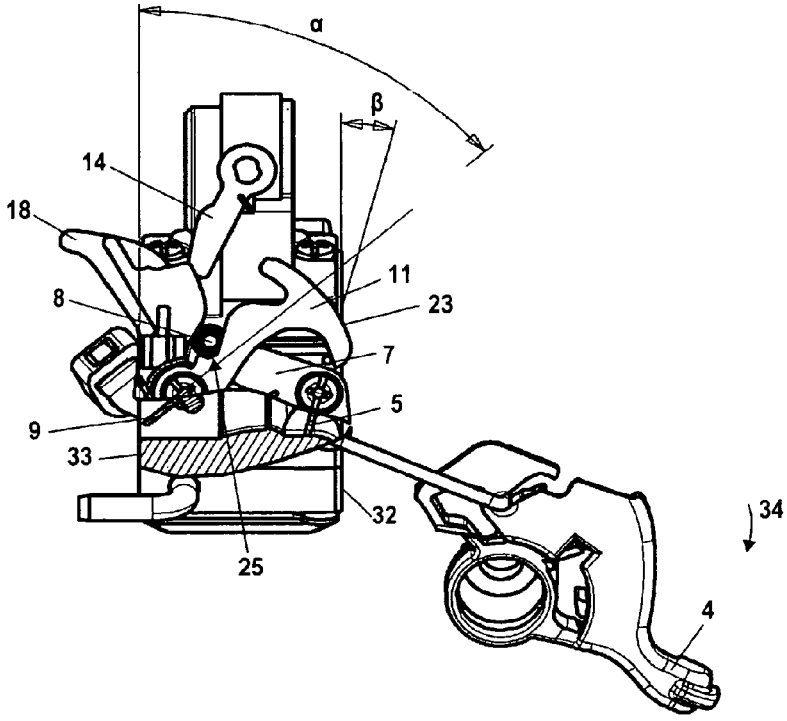
FIG. 4 is a side elevation view of the carburetor assembly of FIG. 3 shown partially in section.

FIGS. 3 and 4 show a carburetor assembly 1 in a cold start position. In this position, the operating-mode position selector 4 is pivoted in the direction of arrow 34 compared to the position shown in FIGS. 1 and 2. Thus, the choke lever 7 is also pivoted. As FIGS. 3 and 4 show, the actuating cam 8 of the choke lever 7 lies against the cam contour 24 of the throttle lever 11. To move the choke lever 7 from the idle position shown in FIGS. 1 and 2 to the position shown in FIGS. 3 and 4, the throttle shaft 10 must first be pivoted about its pivot axis 27 until a blocking contour 23 on the throttle lever 11 is pivoted out of the pivot region of the actuating cam 8. Thereafter, the operating-mode position selector 4 can be pivoted in the direction of arrow 34. In this way, the actuating cam 8 engages with a first latch recess 35 of the cam contour 24.

In the cold start position shown in FIGS. 3 and 4, the choke flap 5 is pivoted by an angle β with respect to the end face 32 of the carburetor 2, preferably about 10° to about 20°. The throttle flap 9 is pivoted by an angle α compared to the end face 33, preferably about 40° to about 60°. The choke flap 5 is thereby fully closed in this position and the throttle flap 9 partially closed. As FIGS. 3 and 4 show, the coupling contour 21 is not engaged with air flap lever 14, so that the air flap 12 is fully closed due to the force of the spring 19.

Figure 5:
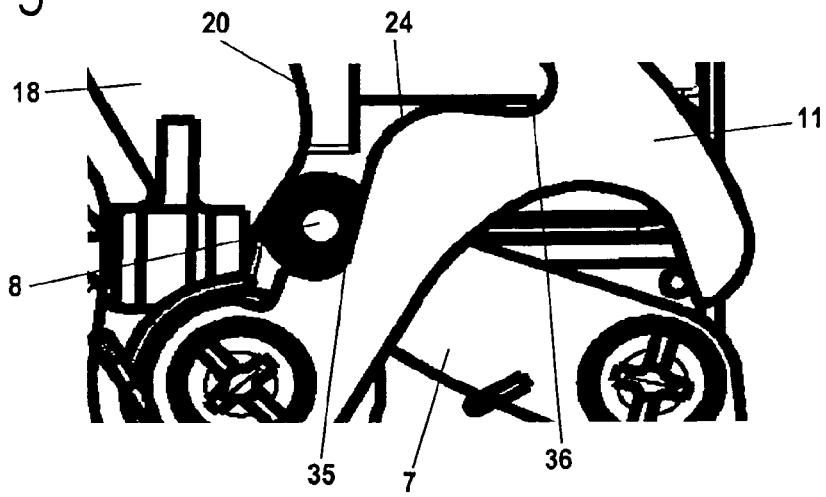
FIG. 5 is an enlarged detail view of the actuating cam of the carburetor assembly of FIG. 4.

In the cold start position shown in FIGS. 3 and 4, a good fixation of the choke lever 7 is desired. To achieve this, the choke lever 7 is held by an element of the first coupling unit 25, namely, the throttle lever 11, as well as by an element of the second coupling unit 26, namely, the coupling lever 18. As FIG. 5 shows, the actuating cam 8 lies against the cam contour 24 of the throttle lever 11. Additionally, the choke lever 7 lies with its lever section against the end face of the blocking section 20 of the coupling lever 18. As a result of the coupling lever 18 being held spring biased on the throttle shaft 10, the coupling lever 18 is pressed against the choke lever 7 and holds it in this position. The choke lever 7 is held clamped between the throttle lever 11 and the coupling lever 18. To release the cold start position, the operator must move the operating-mode position selector 4 opposite to the direction of arrow 34 shown in FIG. 4. In order to release the choke lever 7, the operator must overcome the clamping forces on the choke lever 7 which are applied by the coupling lever 18 and the throttle lever 11.

Figure 6:
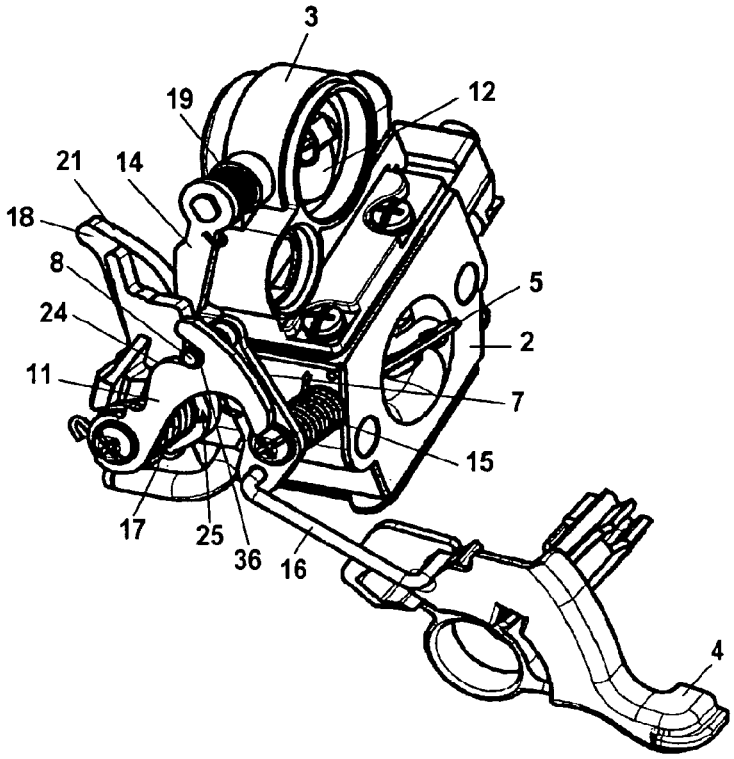
FIG. 6 is a perspective view of the carburetor assembly in a warm start position.
Figure 7:
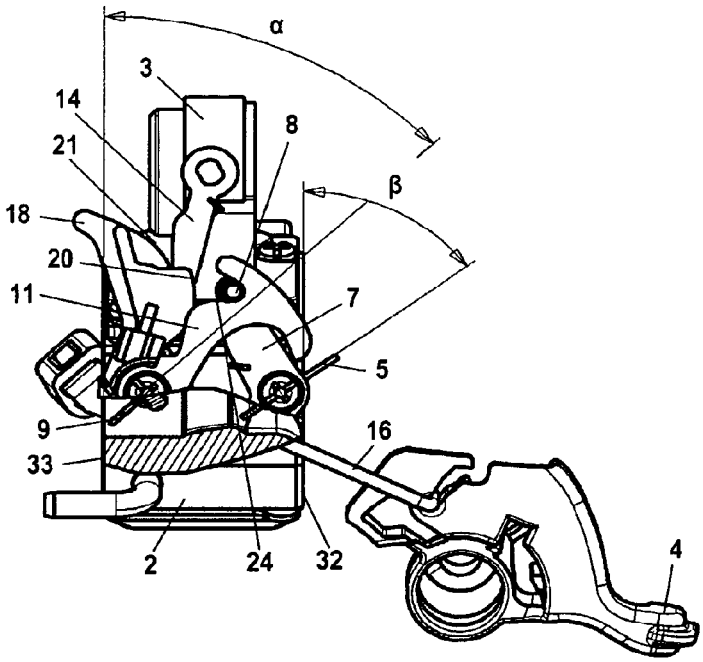
FIG. 7 is a side elevation view of the carburetor assembly of FIG. 6 shown partially in section.

When the operator has pivoted the operating-mode position selector 4, the carburetor assembly 1 gets to the warm start position shown in FIGS. 6 and 7. In this position, the actuating cam 8 lies against the second latch recess 36 of the cam contour 24. The coupling contour 21 of the coupling lever 18 remains unengaged from the air flap lever 14, so that the air flap 12 is fully closed. As shown in FIG. 7, the choke flap 5 is inclined at an angle β relative to the end face 32, advantageously about 50° up to about 60°. The throttle flap 9 can be in the same position as in the cold start position. The angle α, which is conjointly defined by the throttle flap 9 and the end face 33, is advantageously between about 40° and about 60°. As FIGS. 6 and 7 show, the choke lever 7 lies with the actuating cam 8 only against the cam contour 24 in the warm start position. A clamping of the actuating cam is not provided for in this start position.

Figure 8:
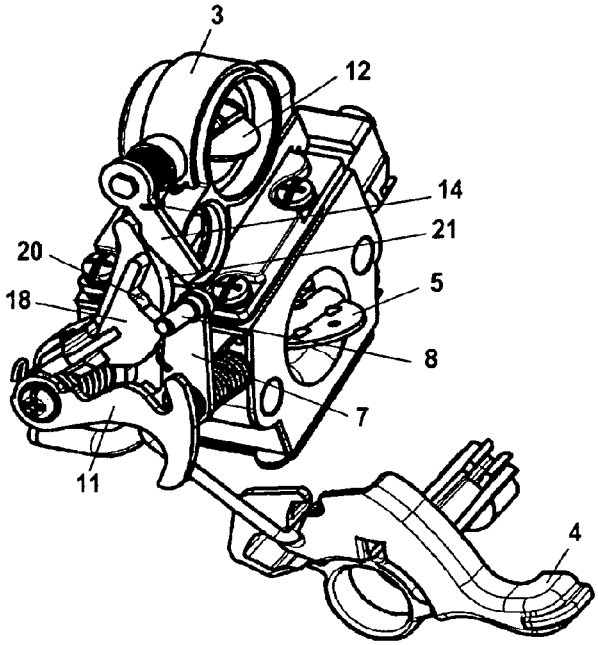
FIG. 8 is a perspective view of the carburetor assembly in full-load position; and, FIG. 9 is a side elevation view of the carburetor assembly of FIG. 8 shown partially in section.
Figure 9:
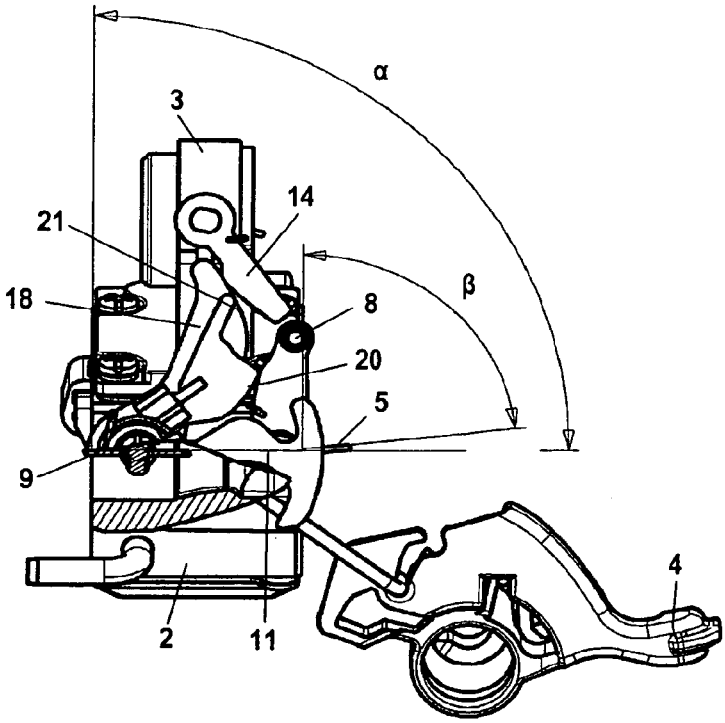

To bring the carburetor assembly 1 from the warm start position as shown in FIGS. 6 and 7 to the full-load position shown in FIGS. 8 and 9, the operator need only press on the throttle. In this way, the throttle shaft 10 is pivoted and the throttle lever pivots downward out of the region of the actuating cam 8. The actuating cam 8 is released and the operating-mode position selector 4 pivots back into the operating position as a result of a spring (not shown).

During pivoting of the throttle flap 9 to the fully opened position shown in FIGS. 8 and 9, the coupling lever 18 also pivots together with the throttle shaft 10. In doing so, the coupling contour 21 engages the air flap lever 14 and pivots it so that the air flap 12 also opens. Advantageously, the air flap 12 opens to the same extent as the throttle flap 9 opens. A delayed opening of the air flap 12 can be advantageous. This can be achieved via an appropriate geometric configuration of the coupling contour 21 and of the air flap lever 14. As FIGS. 8 and 9 show, an engagement of the choke by manipulation of the operating-mode position selector 4 is prevented for the full-load position shown in FIGS. 8 and 9 by the blocking section 20 of the coupling lever 18. As the drawings show, the blocking section 20 is disposed on the same plane as the choke lever 7 while the coupling contour 21 and the air flap lever 14 are arranged on a plane offset in the direction of the pivot axis 27 of the throttle shaft 10 (FIG. 1) and facing the carburetor 2. As a result, the coupling units 25 and 26 do not interfere with each other.

It is understood that the foregoing description is that of the preferred embodiments of the invention and that various changes and modifications may be made thereto without departing from the spirit and scope of the invention as defined in the appended claims.

What is claimed is:

1. A carburetor assembly comprising:

an intake channel having a throttle element and a choke element arranged therein;

an air channel having an air control element arranged therein;

a first coupling unit configured to define the position of said throttle element in at least one start position of the carburetor assembly;

a second coupling unit for coupling the position of said air control element to the position of said throttle element in at least one operating mode;

said first coupling unit being configured to hold said choke element in at least one start position; and, said second coupling unit being configured to additionally hold said choke element in said start position.

2. The carburetor assembly of claim 1, wherein said start position is a cold start position.

3. The carburetor assembly of claim 1, wherein said first coupling unit has a cam contour defining a first start position and a second start position.

4. The carburetor assembly of claim 1, wherein said first coupling unit has a blocking contour configured to prevent a setting of said choke element when said throttle element is closed.

5. The carburetor assembly of claim 1, wherein said first coupling unit further comprises:

a choke lever fixedly connected to said choke element so as to rotate therewith; and, a throttle lever fixedly connected to said throttle element so as to rotate therewith.

6. The carburetor assembly of claim 5, wherein said throttle lever has a cam contour and a blocking contour formed thereon.

7. The carburetor assembly of claim 6, wherein said choke lever has an actuating cam for coacting with said cam contour and said blocking contour.

8. The carburetor assembly of claim 1, wherein said second coupling unit has a coupling contour for actuating said air control element.

9. The carburetor assembly of claim 5, wherein said second coupling unit has a blocking section for coacting with said choke lever.

10. The carburetor assembly of claim 9, wherein said throttle element defines a pivot axis; said second coupling unit has a coupling contour for actuating said air control element; and, said coupling contour and said blocking section are disposed in spaced relationship to each other in the direction of said pivot axis.

11. The carburetor assembly of claim 1, wherein said second coupling unit further comprises:

a coupling lever pivotally journalled relative to said throttle element; and, an air flap lever fixedly connected to said air control element so as to rotate therewith.

12. The carburetor assembly of claim 11, wherein said coupling lever has a coupling contour and a blocking section formed thereon.

13. The carburetor assembly of claim 1, further comprising an operating-mode position selector for selecting at least one start position; and, said operating-mode position selector being operatively connected to said choke element for acting thereon.

14. A carburetor assembly comprising:

an intake channel having a throttle element and a choke element arranged therein;

an air channel having an air control element arranged therein;

a first coupling unit configured to define the position of said throttle element in at least one start position of the carburetor assembly;

a second coupling unit for coupling the position of said air control element to the position of said throttle element in at least one operating mode; and, said first coupling unit and said second coupling unit coacting to hold said choke element in at least one start position; and, wherein the choke element is held clamped in said start position between a member of said first coupling unit and a member of said second coupling unit.

15. The carburetor assembly of claim 14, wherein at least one of said members is spring mounted.

* * * * *